US008459737B2

(12) United States Patent
Brotsch

(10) Patent No.: US 8,459,737 B2
(45) Date of Patent: Jun. 11, 2013

(54) SPINAL SUPPORTING CHAIR ATTACHMENT

(76) Inventor: Brenda Brotsch, Sweetwater, TX (US)

( * ) Notice: Subject to any disclaimer, the term of this patent is extended or adjusted under 35 U.S.C. 154(b) by 206 days.

(21) Appl. No.: 13/118,996

(22) Filed: May 31, 2011

(65) Prior Publication Data

US 2011/0298255 A1 Dec. 8, 2011

Related U.S. Application Data

(60) Provisional application No. 61/352,416, filed on Jun. 8, 2010.

(51) Int. Cl.

| | |
|---|---|
| ***A47C 7/36*** | (2006.01) |
| ***A47C 7/38*** | (2006.01) |
| ***A47C 7/40*** | (2006.01) |
| ***A47C 7/42*** | (2006.01) |

(52) U.S. Cl.

USPC ..... 297/230.1; 297/230.11; 297/230.12; 297/230.13; 297/284.5; 297/352

(58) Field of Classification Search

USPC ..... 297/230.1, 230.11, 230.12, 230.13, 297/230.14, 397, 284.5

See application file for complete search history.

(56) References Cited

U.S. PATENT DOCUMENTS

| | | | | | |
|---|---|---|---|---|---|
| 1,667,626 | A | * | 4/1928 | Epstein | 297/452.32 |
| 1,673,433 | A | * | 6/1928 | Wheeler et al. | 297/230.13 |
| 1,937,920 | A | * | 12/1933 | Smith | 297/452.32 |
| 2,557,874 | A | * | 6/1951 | Kailenta | 297/230.12 X |
| 2,756,808 | A | * | 7/1956 | Eichorst | 297/230.11 |
| 2,769,486 | A | * | 11/1956 | Rabinovitch et al. | 297/230.11 |
| 2,835,311 | A | * | 5/1958 | Reeves et al. | 297/230.11 |
| 2,843,195 | A | * | 7/1958 | Barvaeus | 297/284.4 |
| 3,062,586 | A | * | 11/1962 | Rowland | 297/230.11 X |
| 3,226,159 | A | * | 12/1965 | Binding | 297/397 |
| 3,302,972 | A | * | 2/1967 | Lueders | 297/352 |
| 3,337,264 | A | * | 8/1967 | Collins et al. | 297/230.12 X |
| 3,446,531 | A | * | 5/1969 | Froelich | 297/284.5 |
| 3,464,752 | A | * | 9/1969 | Froelich | 297/230.12 |
| 3,480,323 | A | * | 11/1969 | Propus | 297/230.11 X |
| 3,506,301 | A | * | 4/1970 | Van Santen | 297/230.1 X |
| 3,762,769 | A | * | 10/1973 | Poschl | 297/284.4 |
| 3,813,148 | A | * | 5/1974 | Kraus | 297/230.14 |
| 3,990,743 | A | | 11/1976 | Nelson | |
| 4,045,834 | A | | 9/1977 | Mason | |
| 4,153,293 | A | * | 5/1979 | Sheldon | 297/230.14 X |
| 4,161,337 | A | * | 7/1979 | Ross et al. | 297/230.12 |
| 4,335,725 | A | * | 6/1982 | Geldmacher | 297/284.5 X |
| 4,350,388 | A | * | 9/1982 | Weiner | 297/284.5 X |
| 4,394,783 | A | * | 7/1983 | Simmons | 297/230.1 |
| 4,431,232 | A | * | 2/1984 | Hannouche | 297/284.5 X |

(Continued)

*Primary Examiner* — Rodney B White
(74) *Attorney, Agent, or Firm* — Daniel Boudwin

(57) ABSTRACT

A portable back support device is provided for increasing the spinal support experienced by a user of a low-back chair. The present invention comprises a winged headrest, a back support, a pair of removably attachable armrests, and an adjustable chair strap. The winged head rest and back support may be separatable and removably secured to one another, or alternatively may be may be one piece. The device has cushions of varying contour and firmness and is covered with an upholstery material. Cushioned armrests may be attached at the sides of the back support according to the preference of a user. The device is removably secured to a chair by means of an adjustable strap that fits around the back of a chair and may be tightened or loosened as necessary to affix the device.

3 Claims, 2 Drawing Sheets

U.S. PATENT DOCUMENTS 4,471,993 A * 9/1984 Watson ..... 297/284.5
4,516,568 A * 5/1985 Baxter et al. ..... 297/230.14 X
4,565,405 A * 1/1986 Mayer ..... 297/230.12
4,592,345 A * 6/1986 Wahl ..... 297/230.12 X
4,597,386 A * 7/1986 Goldstein ..... 297/230.13 X
4,634,176 A * 1/1987 Scott ..... 297/230.13 X
4,673,213 A * 6/1987 Bushey et al. ..... 297/230.1 X
4,718,724 A * 1/1988 Quinton et al. ..... 297/284.5
4,819,278 A * 4/1989 Ramos ..... 297/230.14 X
4,862,536 A * 9/1989 Pruit ..... 297/230.14 X
4,981,325 A * 1/1991 Zacharkow ..... 297/230.14 X
5,074,574 A 12/1991 Carwin
5,076,643 A * 12/1991 Colasanti et al. ..... 297/284.6
5,190,347 A * 3/1993 Shiow-Lan ..... 297/284.5
5,251,957 A * 10/1993 Lemens ..... 297/230.1
5,297,848 A * 3/1994 Grinnell ..... 297/230.14 X
5,344,211 A * 9/1994 Adat et al. ..... 297/230.14
5,378,041 A * 1/1995 Lee ..... 297/397 X
5,553,917 A * 9/1996 Adat et al. ..... 297/230.14
5,588,445 A * 12/1996 Obaidi ..... 297/230.1 X
5,624,158 A * 4/1997 Adat et al. ..... 297/230.14
5,690,387 A 11/1997 Sarti
5,803,542 A * 9/1998 Insausti ..... 297/230.12 X
5,803,543 A * 9/1998 Hartmann ..... 297/230.12 X
5,918,933 A * 7/1999 Hutchinson et al. . 297/230.12 X
5,967,613 A 10/1999 McKeever
6,079,784 A * 6/2000 Peachey ..... 297/284.5
6,123,389 A * 9/2000 O'Connor et al. ..... 297/397
6,305,749 B1 * 10/2001 O'Connor et al. ..... 297/397
6,601,804 B2 * 8/2003 Bisch ..... 297/397 X
6,641,220 B2 * 11/2003 Clegg ..... 297/397
6,648,416 B2 11/2003 O'Connor et al.
6,733,074 B2 * 5/2004 Groth ..... 297/284.4
6,893,094 B2 * 5/2005 O'Connor ..... 297/397
6,935,685 B2 * 8/2005 Kassai et al. ..... 297/230.1 X
6,951,367 B1 * 10/2005 Dinnan ..... 297/230.1 X
6,988,772 B2 * 1/2006 Rutty ..... 297/230.1 X
7,083,234 B2 * 8/2006 Dowty et al. ..... 297/230.14 X
7,374,246 B2 * 5/2008 Jones ..... 297/352
7,422,282 B2 * 9/2008 Rutty ..... 297/230.11
7,448,682 B2 * 11/2008 Rutty ..... 297/230.1
7,469,963 B2 * 12/2008 Rutty ..... 297/230.1
7,686,393 B2 * 3/2010 Rutty ..... 297/230.11
7,703,849 B2 * 4/2010 Bilak et al. ..... 297/230.13 X
7,744,158 B2 * 6/2010 Schurg ..... 297/397 X
7,758,119 B1 * 7/2010 Baterdouk ..... 297/230.1
7,909,399 B2 * 3/2011 Rutty ..... 297/230.11
8,087,726 B2 * 1/2012 Chen ..... 297/284.5
8,186,756 B2 * 5/2012 Jorgensen ..... 297/230.12
8,191,969 B2 * 6/2012 Demaras ..... 297/397
8,261,384 B2 * 9/2012 Batiste et al. ..... 297/230.1 X
2005/0127740 A1 * 6/2005 Dowty ..... 297/397 X
2006/0033374 A1 * 2/2006 Pos ..... 297/397
2008/0018158 A1 * 1/2008 Pos ..... 297/397
2008/0211277 A1 * 9/2008 Goetz et al. ..... 297/230.14
2009/0195036 A1 * 8/2009 Timmis ..... 297/397 X
2009/0309399 A1 * 12/2009 Liu ..... 297/230.1
2010/0148560 A1 * 6/2010 MacPherson ..... 297/397
2011/0031790 A1 * 2/2011 Smith, Sr. ..... 297/230.12

* cited by examiner

SPINAL SUPPORTING CHAIR ATTACHMENT

CROSS REFERENCE TO RELATED APPLICATION

This application claims the benefit of U.S. Provisional Application No. 61/352,416 filed on Jun. 8, 2010, entitled "Convert A Chair."

BACKGROUND OF THE INVENTION

1. Field of the Invention

The present invention relates to removable chair attachments, and more specifically to a portable back support attachment.

Often in their daily lives, people are required to sit for extended periods of time. Chairs such as wheelchairs, boat seats, stadium seating and some office chairs offer little to no spinal support for users. The risk of injury due to prolonged sitting is minimal if proper spinal alignment and posture are maintained. However, it can be difficult for a person to sit properly for a lengthy period if their chair does not provide adequate neck and back support. The lack of support can cause users to hunch forward, lean to one side, tilt their heads forward, and a variety of other spinal positions that if repeated over time may lead to injury or health risks.

Risk of spinal injury and skeletal structure damage can be reduced by adding neck and back support to an existing chair. Some users place pillows behind their back or underneath their posteriors. Other users employ head rest attachments to provide neck support. These solutions provide some comfort and reduced risk of injury but they do not address and support all areas of the head and spine. An attachment for a low-back chair is needed that provides comfortable support for a user's back and neck simultaneously.

2. Description of the Prior Art

The prior art contains a variety of cushioned back support devices for attaching to a chair. These devices have familiar design and structural elements for the purposes of providing additional support to a user sitting in a chair, however they are not adapted for the task of providing head, back, and arm support. Nor do they disclose a combination of a winged cushioned headrest with a back cushion, a removable seat cushion, and removable and arm supports.

Nelson, U.S. Pat. No. 3,990,743 discloses a removable back support assembly for use with rigid boating chairs. A small cushion is attached to a rigid planar member that is removably affixed to a boating seat. The back support of Nelson is not secured to a winged head. The back support does not attach to a chair by means of a securing strap. Additionally, the back support does not disclose removably-affixable arm rests or seat cushions.

Mason, U.S. Pat. No. 4,045,834 discloses a collapsible back rest support for a boating seat. The back rest comprises two rods having fabric stretched between them, which serve as a back support. This back support is hingedly connected to a pair of support rods having chair clips attached at their back ends. Chair clips and support rods allow the device to be secured to a boat seat, unlike the securing strap of the present invention. The back support of Mason is not cushioned and is not attached to a winged head rest. There is no means for removably attaching cushioned armrests or a seat cushion.

Simmons, U.S. Pat. No. 4,394,783 discloses a portable cushion having a top, bottom, and base cushions connected by adjustable straps. The cushion has shoulder straps for attaching to a user, and a chair strap for securing the cushion to a user's chair instead of their body. It does not disclose a hard frame attached to and support of the body cushions. The head cushion of Simmons is merely a flat pillow, not a winged headrest. Additionally there are no removably attached arm rests contemplated by Simmons.

O'Connor et al, U.S. Pat. No. 6,648,416 discloses a portable winged head rest having between one and two side wings. Said side wings may be integrally connected to a rigid back portion or may be hingedly attached to allow the device to collapse. The winged headrest is not cushioned as with the present invention. A chair strap is attached to the back portion so that the device may be secured to a user's chair. O'Connor's headrest is not secured to a cushioned back support, nor does it include means for removably attaching a seat cushion or armrests.

McKeever, U.S. Pat. No. 5,967,613 discloses a headrest attachment having a winged cushioned headrest and two cushioned shoulder supports. The headrest and shoulder supports are connected to each other and a chair by a metal skeleton frame. The device provides support to a user's neck and shoulders but does not include a cushioned back support to provide comfortable support to a user's back. The headrest of McKeever also fails to disclose removably attached armrests or a removably attached seat cushion. The headrest does not secure to a chair by means of a chair strap.

Sarti, U.S. Pat. No. 5,690,387 discloses a portable head rest device having a pocket portion, a support means, and a head cushion. Said pocket is adapted to fit over the back of a chair and is attached via said support means to a head cushion. This pocket attachment does not provide cushioned back support like that of the present invention. Said pocket attachment is the securing means for the Sarti invention, rather than a chair strap. The device has optional support arms that may screw in adjustably along the sides of the pocket portion a headrest. Sarti does not disclose a removable seat cushion nor does it provide for removably attached armrests.

Jones, U.S. Pat. No. 7,374,246 discloses a cushioned chair attachment device having a seat cushion adjustably attached to a back cushion. Both cushions have a securing means for removably attaching the cushion to a chair seat or back. The back cushion does not have a means for removably attaching cushioned armrests. Jones does not disclose a cushioned winged headrest secured to the top of the back cushion.

The devices disclosed by the prior art do not address the need for a portable back support cushion having a headrest, back support, and optional seat cushion and arm rests. The current invention relates to a device for providing cushioned support to a user sitting in a chair. It substantially diverges in structural elements from the prior art, consequently it is clear that there is a need in the art for an improvement to the existing portable cushioned support devices for automobiles. In this regard the instant invention substantially fulfills these needs.

SUMMARY OF THE INVENTION

In view of the foregoing disadvantages inherent in the known types of cushioned back support devices now present in the prior art, the present invention provides a new headrest and back support combination with removable armrests, wherein the same can be utilized for providing convenience for the user when sitting in a low-back chair. The device comprises a winged headrest, a back support, a pair of removably secured armrests, and an adjustable securing strap. Said back support portion includes a rigid frame arcuately angled away from a user and having a rectangular cushion attached along its front. Secured to a top end of the back support portion is a winged head rest. The headrest includes a rigid frame support having a middle portion and two side portions, attached at opposing ends of said middle portion and angled outward. Each of the portions is covered on its inner surface by a cushion to support a user's head in a variety of positions. The frames of the head rest and back support may be constructed separately or may be made of a single piece of molded material. Any strong rigid material such as wood or plastic can be used to construct the frame. The back cushion and cushioned head rest offer comfortable back and neck support to a user sitting in a low-back chair.

To increase user comfort and support, the device has a pair of armrests that are removably attachable by a screw means. The arm rests may be connected to the device along its sides and angularly positioned according to a user's preference. In one embodiment the armrests have cushions attached along the upper armrest surfaces. In an alternate embodiment the armrests may have cushions that extend from the armrest to the seat. In another embodiment, the device may have a horizontal seat cushion for a user to sit upon. Said seat cushion attaches to the bottom of the back support via a securing means such as hook and loop fastening, buttons, or a zipper. Any type of cushion and covering material may be used in the device's construction.

All embodiments of the device may be removably secured to a chair by means of an adjustable strap. The strap is attached to the device at laterally opposing points on the sides of the back support portion. To use the device, a user wraps the adjustable support straps around a chair back such and tightens the strap until the device is snuggly secured. Arm rests may be added and their position adjusted to optimize comfort for a user. The user then sits on the chair and leans backward against the device for improved spinal support and increased comfort, particularly over long seated durations wherein fatigue is an issue. In this manner the device provides greater comfort to a user of a low-back chair, and promotes reduction of neck and back injuries due to lack of spinal support.

It is therefore an object of the present invention to provide a new and improved portable back support device having all the advantages of the prior art and none of the disadvantages.

Another object of the present invention is to provide a new and improved portable back support device having rigid frame attached to a cushioned winged head rest and a cushioned back support, which may be adjustably secured to a low-back chair.

Yet another object of the present invention is to provide a new and improved portable back support device having removably attachable armrests that may be positioned according to a user's preference.

Still another object of the present invention is to provide a new and improved portable back support device having a removably-attached, horizontal seat cushion for providing posterior support to a user.

A further object of the present invention is to provided a new and improved portable back support device having resilient and durable construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein.

DESCRIPTION OF THE INVENTION

Figure 1:
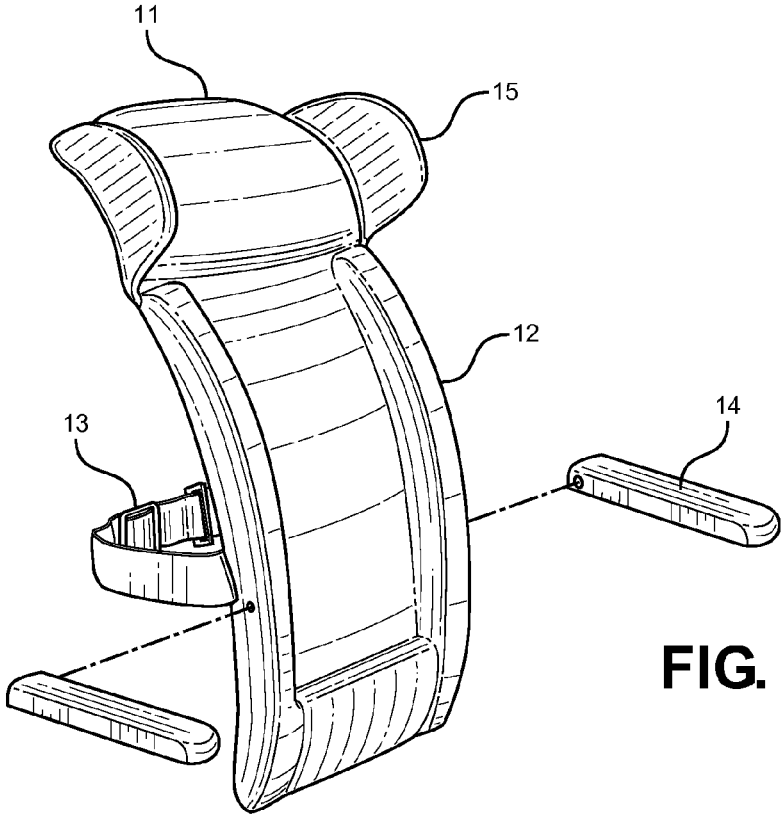
FIG. 1 shows a perspective view of a back support device according to the present invention.

Reference is made herein to the attached drawings. Like reference numerals are used throughout the drawings to depict like or similar elements of the portable back support device. For the purposes of presenting a brief and clear description of the present invention, the preferred embodiment will be discussed as used for providing back and neck support to a user of a low-back chair. The drawings are provided for representative purposes only and should not be considered to be limiting in any respect.

Figure 2:
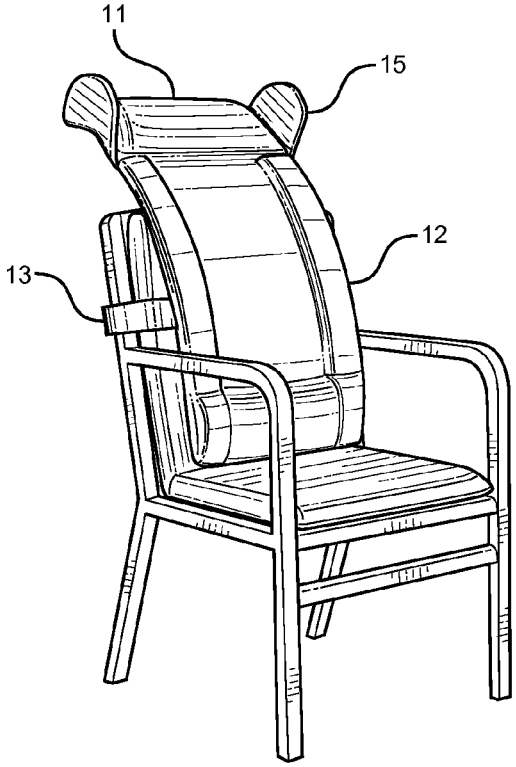
FIG. 2 shows a perspective view of a back support device according to the present invention, attached to a low-back chair.
Figure 3:
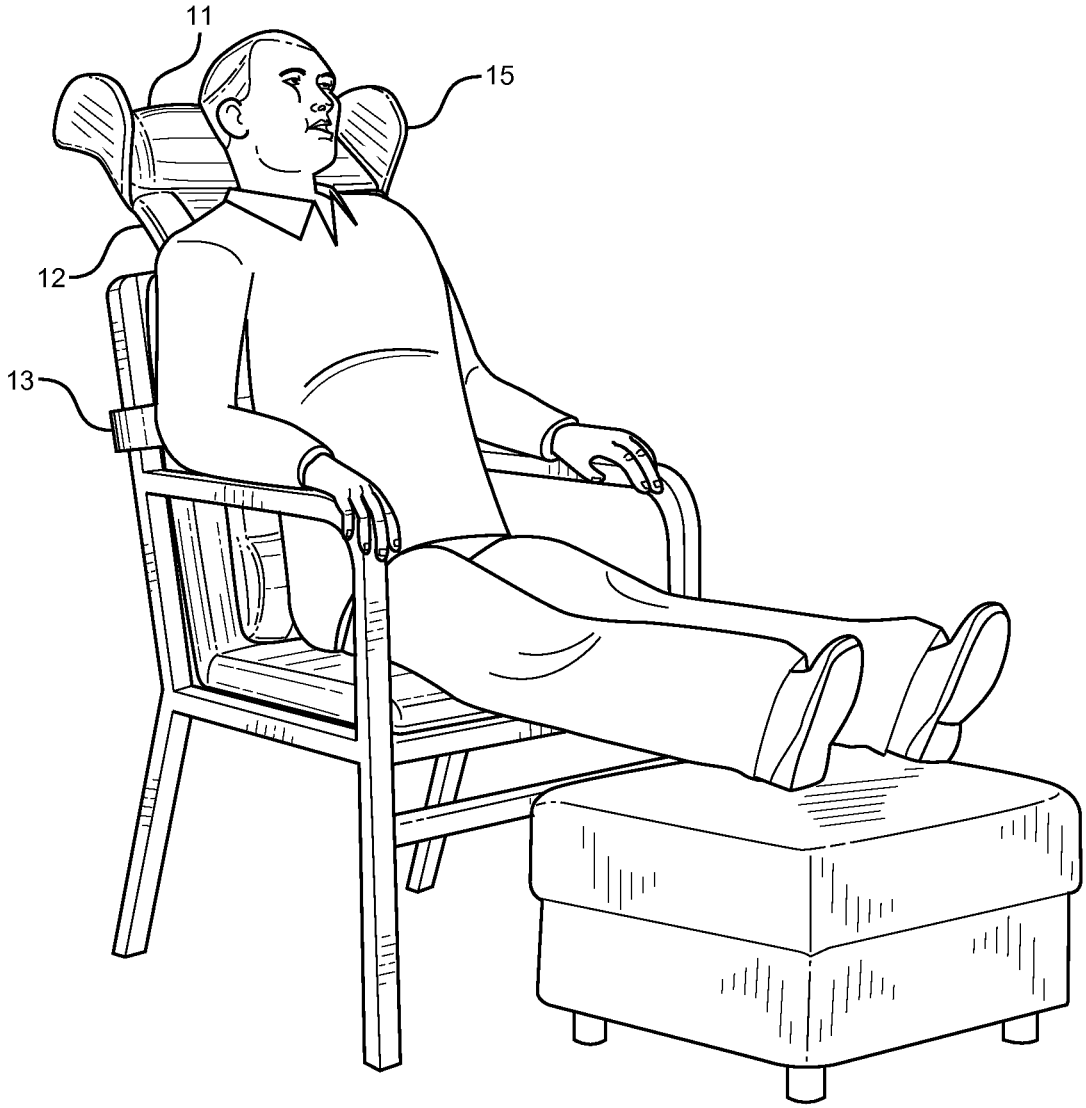
FIG. 3 shows a perspective view of a portable back support device according to the present invention being operated by a user.

Referring now to FIG. 1 through FIG. 3, there is shown a portable back support device according to the present invention. The device comprises a winged head rest 11, a back support 12, an adjustable attachment strap 13, and a pair of removably attachable armrests 14. The back support 12 and winged head rest 11 include a continuous, rigid frame support with cushions provided therein and protected by an outer covering material. The frame supports may be individually combined portions adapted to removably secure together at the top end of said back support 12 and bottom end of said winged head rest 11. Alternatively the frame support may be made of a singular of material such that the head rest 11 and back support 12 are permanently connected. This frame support may be constructed of any rigid, durable material such as molded plastic, or wood.

The winged head rest 11 has two side portions 15 and a middle portion lying therebetween. Cushions extend across the head rest 11 and side portions 15. The cushions may have varying firmness and contour. To provide support without causing a user to stretch his or her neck backwards, the head rest 11 has a slight degree of tilt towards the user. The winged head rest 11 may be removably attached or permanently secured to the back support 12 depending on the construction of the support frame.

A back support 12 having a backwardly arcuate quality is the main body of the device. A rectangular cushion is attached to the back support 12. In the preferred embodiment the cushion is fifteen inches wide and eighteen inches tall, however other dimensions are contemplated. This cushion may have varying firmness and contour to provide a user with greater support in different areas of the back. The device is secured to a chair by an adjustable strap 13 attached to the back support 12 at its sides. The adjustable strap 13 may have securing means such as hook and loop fastening, buttons, or buckles such that the device may be positioned and the strap 13 then fastened around the back of a chair. Alternatively, the strap 13 may comprise an adjustable belt having no fasteners and secured to a chair by lowering the device over the back of a chair so that the chair back is positioned between the device and the strap 13.

A pair if armrests 14 removably secures to the device at the sides of the back support 12. Each armrest 14 may be secured to the back support 12 by a screw means disposed along the inside of an arm end. The screw means operative connects with a threaded recess in the side of the back support 12 to affix the armrest 14 in place. Cushions may be attached to the top surface of the armrests 14 to increase comfort. Any durable, flexible upholstery material may be used to cover the device. Materials such as fabric, leather, and faux-suede are suggested but other options are contemplated.

In an alternate embodiment, the armrests 14 may also include continuous cushions extending from the armrest 14 to a chair seat. Another alternate embodiment includes a removably attachable seat cushion (not shown) that lies flat on the seat to provide posterior support for the user. Said seat cushion attaches at the bottom end of the back support 12 by a securing means. The securing means may be a zipper, hook and loop fastening, buttons, or any other fasteners. A variety of cushion firmness and contours may be used according to the support needs of a user.

In use the device is secured to a low-back chair such that the bottom of the device abuts the chair seat. This may be accomplished by placing the back support 12 against the back of the chair then fastening the adjustable strap 13 behind the chair back, and adjusting the strap's tightness as necessary. Alternatively, a user may slide the device downward onto the chair so that the chair back is positioned between the back support 12 and the adjustable strap. After the device is in position, a user may elect to utilize the installed device or add armrests 14 and a horizontal seat cushion. A user screws each armrest 14 into place on the side of the back support 12 until the armrest is at a desired tightness and angle of inclination. The seat cushion may be added by attaching the cushion to the bottom of the back support 12 by means of fasteners. A user then sits in the chair and leans backward against the device, placing his or her head in the winged headrest 11 and arms upon the armrests 14. In this manner the device provides comfortable neck and back support for a user of a low-back chair.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. A portable head and back support attachment for a low-back chair, comprising:

a headrest having a headrest frame including a pair of side portions and a middle portion lying therebetween, said side portions being angled forward from said middle portion, said side and middle portions having a cushion thereon, a forwardly curving back support having a back support frame, wherein the back support curves toward a user's back when in use, said back support frame having a largely rectangular cushion thereon, a pair of armrests being removably attachable to each lateral side of said back support via screw means, said armrests having a cushion thereon, an adjustable chair strap attached extending from opposing lateral sides of said support frame and attaching together at their terminal ends, said head rest, back support, seat and armrest cushioning being covered in an upholstery material.

2. The device of claim 1, wherein said headrest frame and frame support are constructed as one member.

3. The device of claim 1, wherein said armrest and said back support cushions are constructed as one member.

* * * * *